US008239979B2

(12) United States Patent
Seymour et al.

(10) Patent No.: US 8,239,979 B2
(45) Date of Patent: Aug. 14, 2012

(54) MODULAR EASY ACCESS BATHING ENCLOSURE

(75) Inventors: Michael Wm. Seymour, Aliso Viejo, CA (US); Deon Colchester, Huntington Beach, CA (US); Robert Rotstan, Jr., Aliso Viejo, CA (US); Carl Tenbrink, Huntington Beach, CA (US)

(73) Assignee: Axcess Innovations Inc., Huntington Beach, CA (US)

( * ) Notice: Subject to any disclaimer, the term of this patent is extended or adjusted under 35 U.S.C. 154(b) by 382 days.

(21) Appl. No.: 12/539,247

(22) Filed: Aug. 11, 2009

(65) Prior Publication Data

US 2011/0035871 A1 Feb. 17, 2011

(51) Int. Cl.
*A47K 3/02* (2006.01)

(52) U.S. Cl. ..... 4/556

(58) Field of Classification Search ..... 4/556, 538, 4/555

See application file for complete search history.

(56) References Cited

U.S. PATENT DOCUMENTS

| | | | | | |
|---|---|---|---|---|---|
| 2,231,314 | A | * | 2/1941 | Amour | 74/831 |
| 2,510,023 | A | | 4/1947 | La Barre | |
| 2,569,825 | A | * | 10/1951 | Otis | 4/556 |
| 2,611,135 | A | * | 9/1952 | Greene | 4/292 |
| 2,714,725 | A | * | 8/1955 | Boone | 4/569 |
| 2,977,604 | A | * | 4/1961 | Miller | 4/577.1 |
| 3,066,316 | A | * | 12/1962 | Russell | 4/556 |
| 3,380,078 | A | * | 4/1968 | Hanson | 4/555 |
| 3,561,019 | A | | 2/1971 | Roland | |
| 3,562,821 | A | * | 2/1971 | Queen | 4/604 |
| 3,604,018 | A | * | 9/1971 | Moran | 4/556 |
| 3,663,971 | A | * | 5/1972 | Bonhote | 4/556 |
| 3,719,960 | A | * | 3/1973 | Russell | 4/556 |
| 3,863,275 | A | * | 2/1975 | Brendgord et al. | 4/556 |
| 3,918,108 | A | * | 11/1975 | Feyerherm | 4/563.1 |
| D248,107 | S | * | 6/1978 | Brendgord et al. | D23/279 |
| 4,099,272 | A | * | 7/1978 | Sowder | 4/555 |
| 4,360,935 | A | * | 11/1982 | Barrett, Sr. | 4/555 |
| 4,542,545 | A | * | 9/1985 | Johnson et al. | 4/555 |
| 4,583,251 | A | * | 4/1986 | Furst et al. | 4/555 |
| D297,161 | S | * | 8/1988 | Weschta | D23/279 |
| 4,953,241 | A | * | 9/1990 | Williams | 4/556 |
| D326,508 | S | * | 5/1992 | Sauter et al. | D23/279 |
| 5,163,187 | A | * | 11/1992 | Dannenberg et al. | 4/556 |
| D332,827 | S | * | 1/1993 | Dannenberg et al. | D23/279 |
| 5,184,358 | A | * | 2/1993 | Gruidel et al. | 4/555 |
| 5,220,696 | A | * | 6/1993 | Dannenberg et al. | 4/556 |
| 5,255,400 | A | * | 10/1993 | Sween | 4/556 |
| D352,099 | S | * | 11/1994 | Andersen | D23/279 |
| D355,245 | S | * | 2/1995 | Sills et al. | D23/279 |
| 5,446,929 | A | * | 9/1995 | Sills et al. | 4/555 |

(Continued)

FOREIGN PATENT DOCUMENTS

EP 0 700 655 A1 3/1996

(Continued)

*Primary Examiner* — Lori Baker
(74) *Attorney, Agent, or Firm* — Walter A. Hackler

(57) ABSTRACT

A modular easy access bathing enclosure includes a shell having a seating area and a standing area with a contiguous sidewall. The sidewall around the standing area includes an access opening extending from a shell top to an opening bottom proximate the standing area. A pocket door is provided for enclosing the access opening and is movable into the sidewall surrounding the standing area. Inflatable gaskets are provided for sealing and locking the door in the access opening.

25 Claims, 6 Drawing Sheets

U.S. PATENT DOCUMENTS

| | | | | |
|---|---|---|---|---|
| 5,463,780 | A * | 11/1995 | Harris et al. | 4/604 |
| 5,549,149 | A * | 8/1996 | Sills et al. | 160/201 |
| 5,701,614 | A * | 12/1997 | Appleford et al. | 4/555 |
| 5,813,062 | A * | 9/1998 | Vago et al. | 4/556 |
| 5,940,902 | A | 8/1999 | Onge et al. | |
| 6,101,642 | A | 8/2000 | Auten et al. | |
| 6,151,727 | A | 11/2000 | Lofquist, Jr. | |
| 6,351,860 | B1 * | 3/2002 | Schaffer | 4/563.1 |
| 6,381,769 | B1 * | 5/2002 | Lofquist, Jr. | 4/555 |
| 6,766,543 | B1 * | 7/2004 | Hollis et al. | 4/555 |
| 7,237,276 | B2 * | 7/2007 | Longman | 4/555 |
| D573,700 | S * | 7/2008 | Clarke | D23/279 |
| 7,475,954 | B1 * | 1/2009 | Latunski | 312/297 |
| 7,788,783 | B2 * | 9/2010 | Neidich | 29/447 |
| 7,926,126 | B2 * | 4/2011 | Whitley | 4/555 |
| 2008/0178380 | A1 * | 7/2008 | Rydalch | 4/555 |
| 2011/0056013 | A1 * | 3/2011 | Seymour et al. | 4/560.1 |

FOREIGN PATENT DOCUMENTS

| | | | |
|---|---|---|---|
| FR | 2 889 934 | A1 | 3/2007 |
| GB | 2 333 699 | A | 8/1999 |
| GB | 2 334 438 | A | 8/1999 |
| JP | 2008 239 269 | A | 10/2008 |

* cited by examiner

FIG. 4.
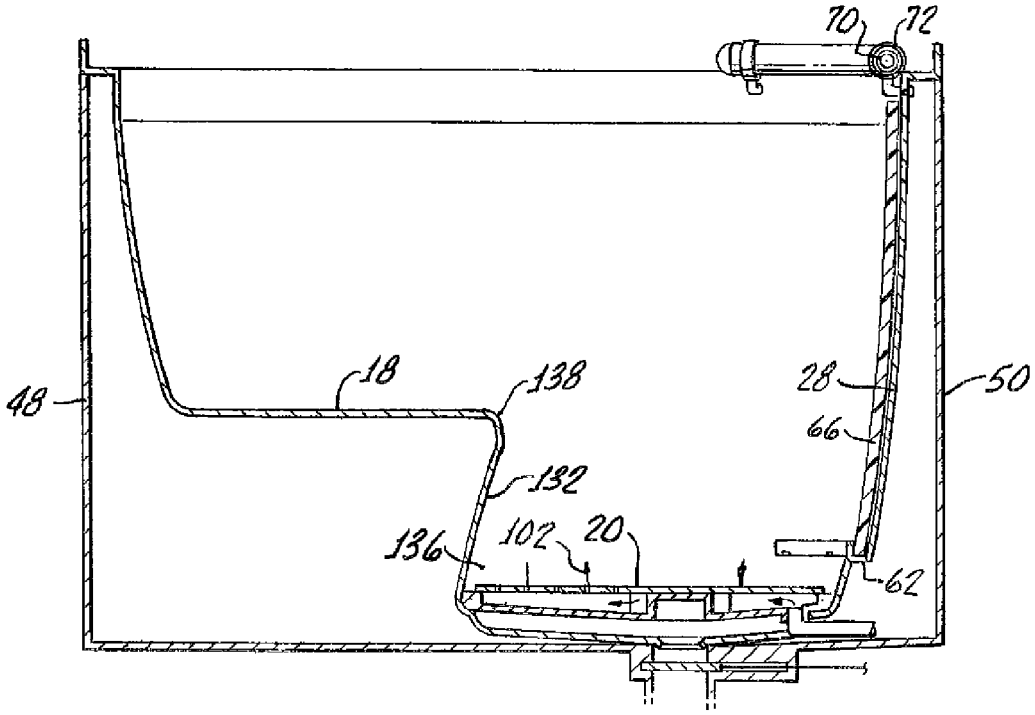
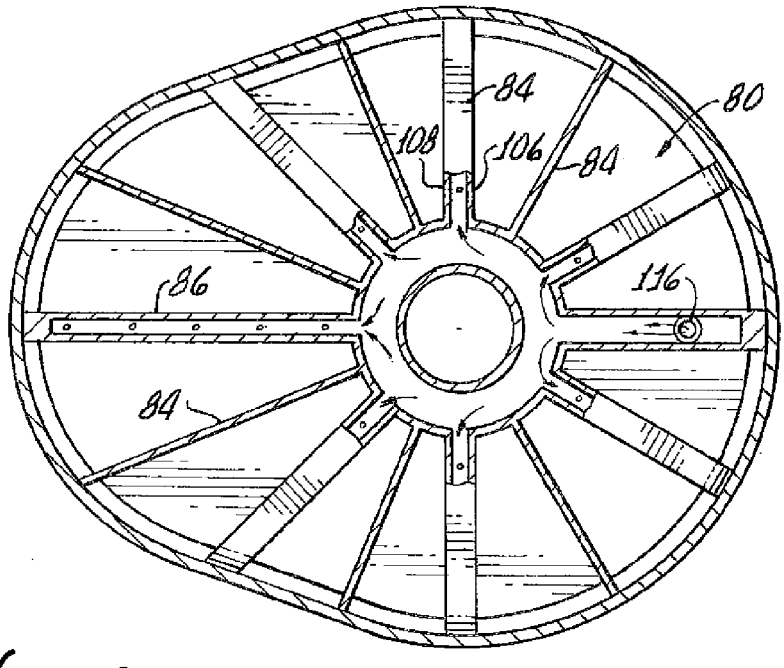
FIG. 9.

MODULAR EASY ACCESS BATHING ENCLOSURE

The present invention generally relates to bathtubs and bathtub/shower combinations that satisfies the needs of impaired persons who find the use of a conventional bathtub difficult, if not impossible.

Typical bathtubs have raised walls that a bather must step over, thus making access thereto difficult or impossible for many disabled bathers.

Walk-in bathtubs are becoming increasingly common in hospitals, nursing homes, and most recently private homes.

In addition to safety, the ease of entering a bathtub by way of a door additionally provides bathers independence thus enabling bathing without the assistance of another person when getting into and out of the bathtub.

Unfortunately, such bathtubs typically require more space for doors, tracks, lifts, and other components than is available in typical bathrooms. In addition, the size of such units prohibits retrofitting or installation into an existing bathroom, without removal and replacement of walls, doors, or windows.

The present invention provides for modular easy access bathing enclosure which is preferably dimensioned to be comparable to a full-size, or soak-bath type bathtub, and yet capable of being installed in a typical bathroom either as a new installation or as a retrofit.

SUMMARY OF THE INVENTION

A modular easy access bathing enclosure in accordance with the present invention generally includes a shell having a bathing area with an arcuate sidewall including an access opening extending from a shell top to an opening bottom, an arcuate sliding door is provided for enclosing the access opening, as well as gaskets for sealing and locking the door in the access opening.

In one embodiment, the door is slideable adjacent the sidewall and in another embodiment the door is slideable within the sidewall for supporting the door.

More particularly, a modular easy access bathing enclosure in accordance with the present invention generally includes a shell having a seating area and a standing area with a contiguous sidewall. The sidewall around the standing area includes an access opening extending from a top of the shell to a point proximate the standing area.

A pocket door is provided for enclosing the access opening and is movable into or adjacent to a sidewall surrounding the standing area for enabling entry into the bathing enclosure by a bather. Inflatable gaskets provide for both sealing and locking the door in the access opening.

In a preferred embodiment, the sidewall has a parabolic surface of revolution (PSR) shape around the standing area and the PSR shape extends outwardly from the standing area. This provides for more "elbow room" for a bather standing on the standing area. In this instance the pocket door also has a PSR shape and, when closing the access opening, a "teacup" shape is provided for the bather.

More particularly, a track is disposed adjacent to or within the sidewall around the standing area for supporting the door and a drain is provided at a bottom of the shell along with the drain valve.

A frame is provided for supporting the shell, and front and side panels are also provided for enclosing the frame. The front panel may be generally planar and includes a cutout for alignment with the shell access opening and in a preferred embodiment the pocket door extends outwardly from the front panel, when sealing the access opening, due to the PSR shape thereof.

This modular arrangement enables on-site assembly and importantly passage through a conventional doorway, thus eliminating the need for undesired tear-out of existing bathroom walls, doors, or windows in order to install the bathing enclosure in accordance with the present invention.

For both safety and convenience, a door handrail is disposed proximate a door top for facilitating opening and closing of the door and assistance in steadying an unstable bather. In addition, a shell handrail is provided which is disposed proximate the shell top, which includes a piston, disposed therein. The piston is connected to the door handrail for hydraulically opening and closing the door thus providing independent operation for an impaired bather lacking strength or mobility for operation of the door.

A top front panel, top side panels, and a top door panel may be provided which are attachable, respectively to the front panel, side panels, and door, for providing a showering area for the bather.

Still more particularly, the standing area may be for the most part, generally circular and the drain is disposed proximately center of the standing area. In order to provide a level standing area, a removable grate may be provided for covering the standing area. The grate enables water passage therethrough and may include a plurality of support ribs on an underside thereof for stabilizing the grate on the standing area.

In one embodiment of the present invention, some of the support ribs may be hollow and communication with holes in the grate and an air supply for causing bubbling in a water filled shell.

In addition, the seating area may be elevated from the standing area and interconnected by a seat wall enabling a seated bather to have a heel position directly below a seat edge thus facilitating standing of the bather from a seated position.

BRIEF DESCRIPTION OF THE DRAWINGS

The advantages and features of the present invention will be better understood by the following description when considered in conjunction with the accompanying drawings in which:

FIG. 4 is a cross sectional view of the enclosure of FIG. 2 and adjacent sliding door more clearly illustrating a parabolic surface of revolution shape of the sidewall around a standing area along with the seat wall interconnecting a seating area with a standing area and also a grate over the standing area;

FIG. 9 is a cross sectional view taken along the line 9-9 of FIG. 8 illustrating how support ribs and holes in the grate for providing bubbling in the enclosure;

DETAILED DESCRIPTION

Figure 1:
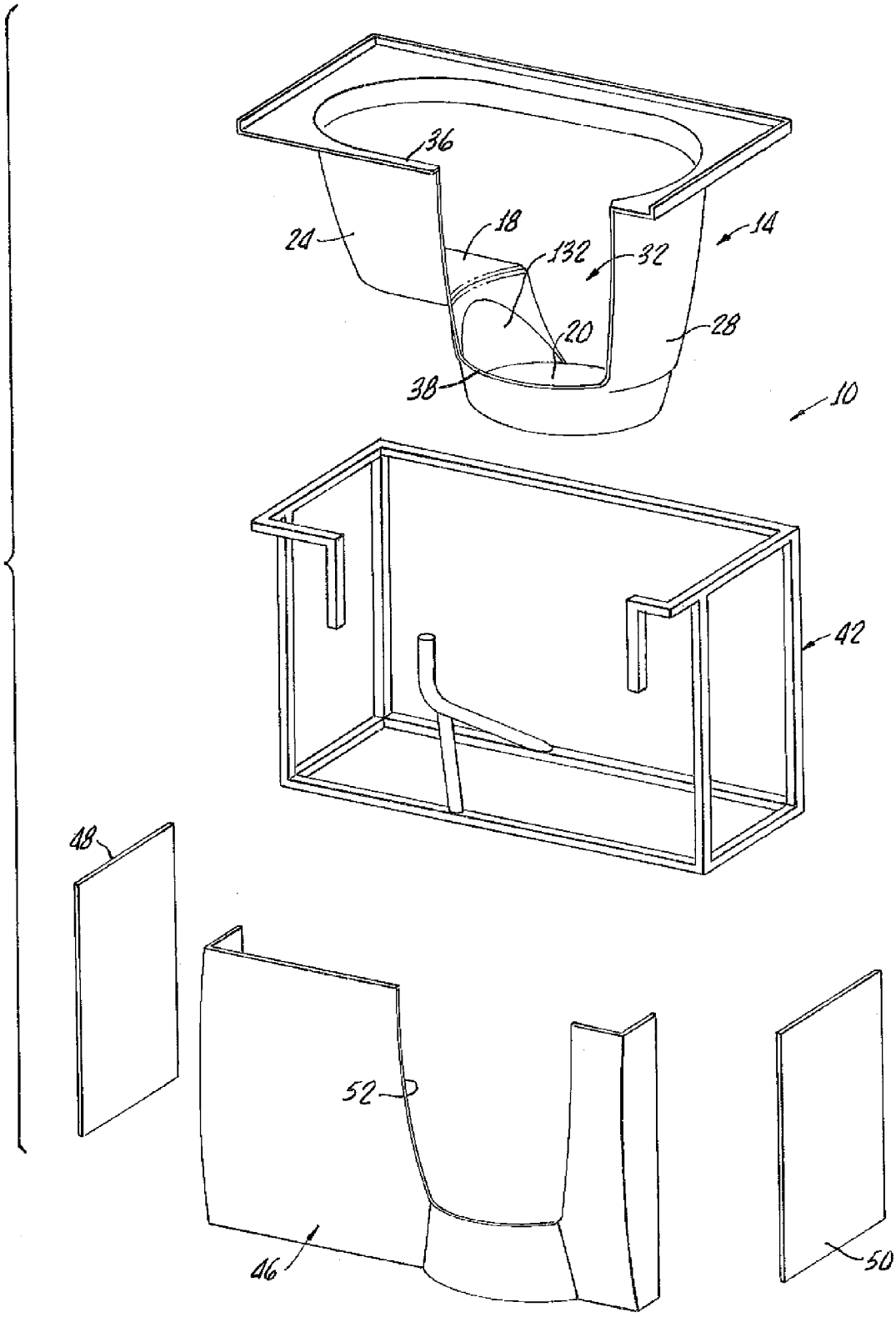
FIG. 1 is an exploded view of a modular easy access bathing enclosure in accordance with the present invention illustrating individual components such as a shell, frame, front and side panels, that can be carried into a room and assembled on-site.
Figure 2:
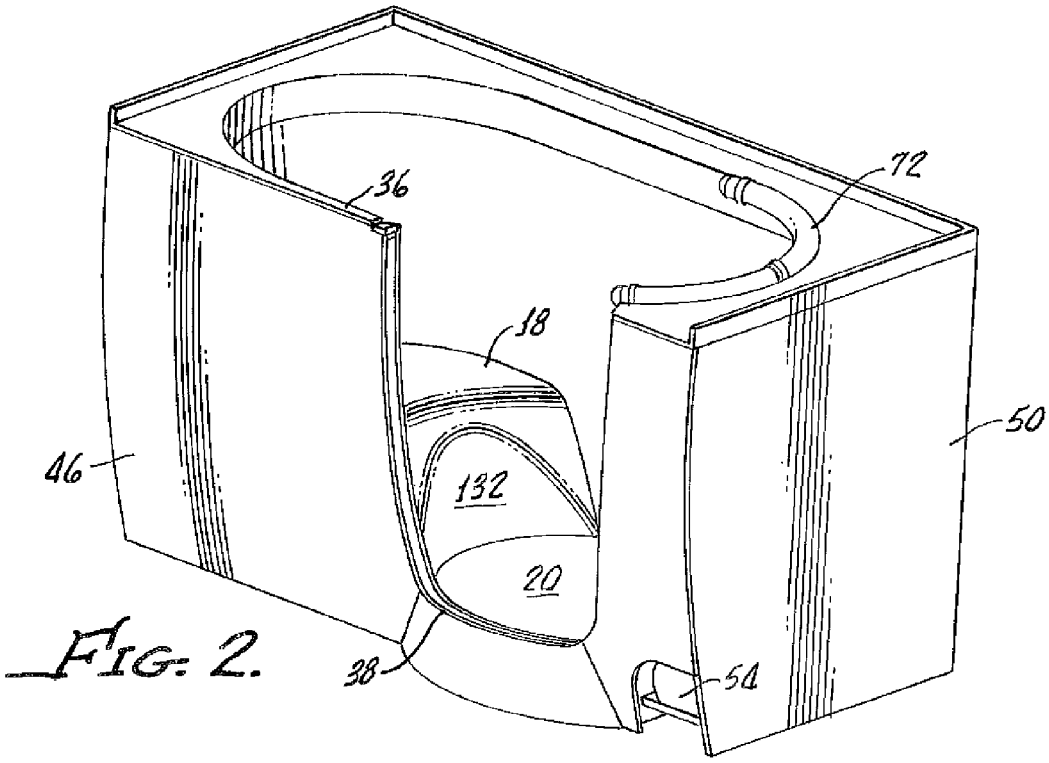
FIG. 2 is a perspective view of an assemble enclosure having an open access opening.
Figure 3:
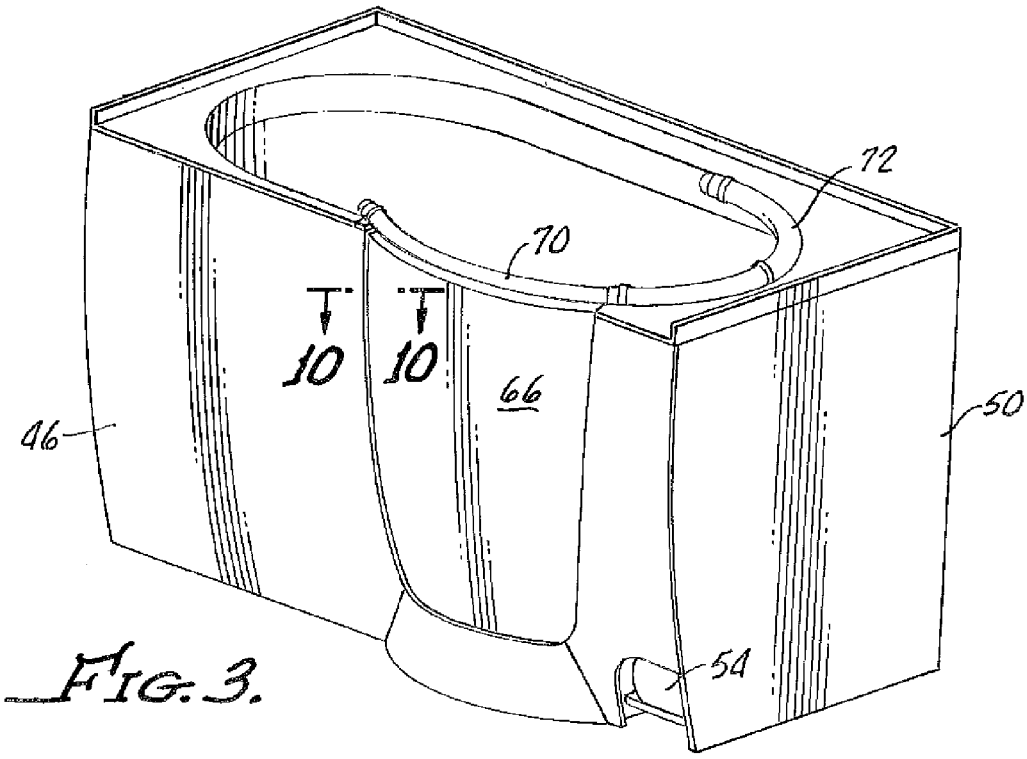
FIG. 3 is a perspective view similar to FIG. 2 illustrating closure of the access opening by a pocket door.
Figure 5:
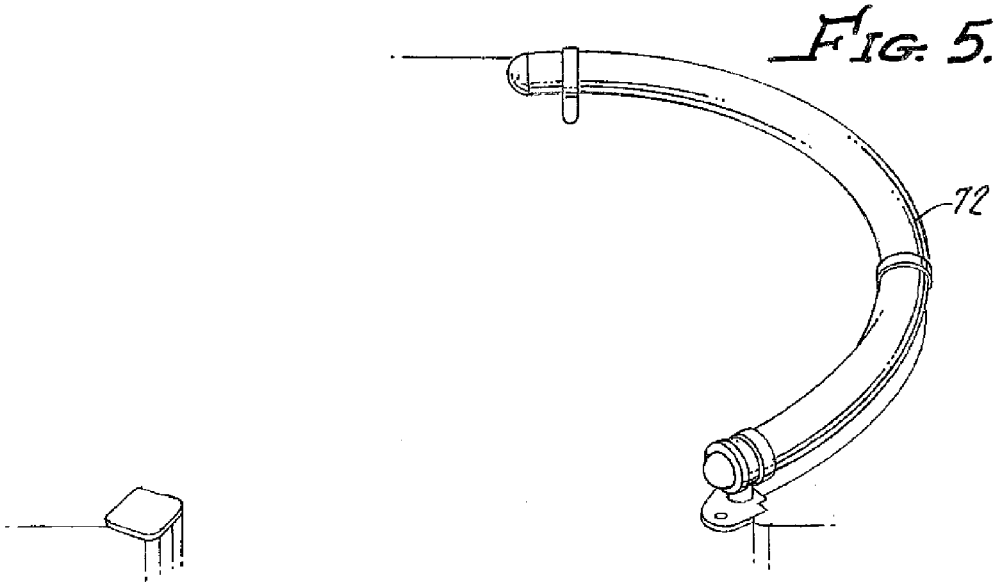
FIG. 5 is an enlarged perspective view of a shell handrail.
Figure 6:
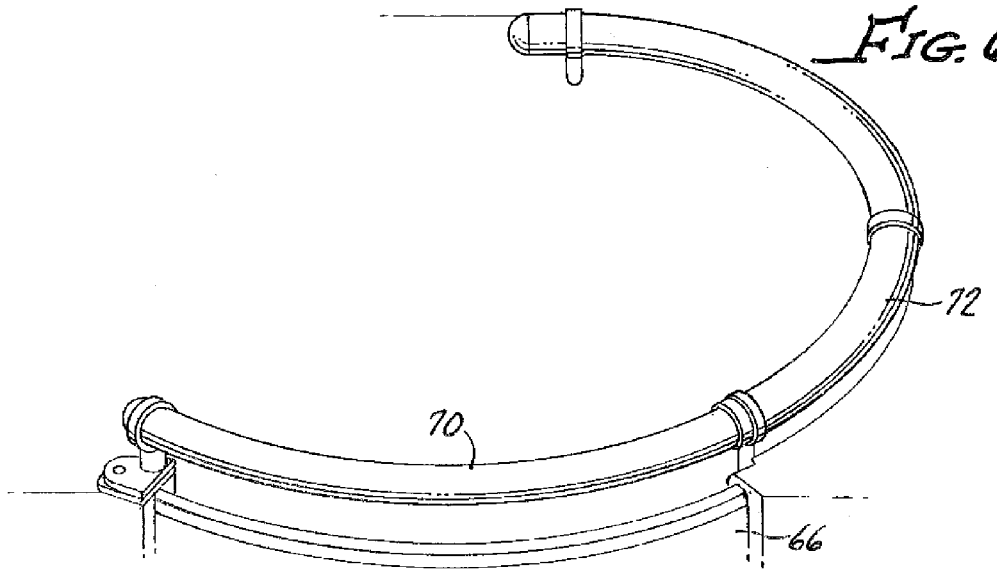
FIG. 6 is a perspective view of a door handrail.

With reference to FIGS. 1-3, there is shown a modular easy access bathing enclosure 10 in accordance with the present invention which generally includes a shell 14 having a seating area 18 and a standing area 20 with a contiguous sidewall 24. A sidewall portion 28 around the standing area 20 includes an access opening 32 extending from a shell top 36 to an opening bottom 38 which is proximate the standing area 20. A frame 42 is provided for supporting the shell 14 along with a front panel, or fascia, 46 and side panels 48, 50 all attachable to the frame 42 in a conventional manner. The front panel 46 includes a cutout 52 for alignment with the access opening 32.

Importantly, the shell 14, frame 42, and panels 46, 48, 50 are all fabricated for onsite assembly and passage through a conventional doorway such as, for example, but not limited to a 34-inch wide doorway (not shown). The shell 14, frame 42, and panels 46, 48, 50 may be formed from any conventional material including but not limited to gel-coated fiberglass, or acrylics.

The modular nature of the enclosure 10 enables the use of fascias 46 of various designs to be utilized in order to match or compliment various bathroom decors. In addition, the fascias may be removed at any time to facilitate access to workings, pump lines, etc., not shown, for bath installation and repair. In addition, a separate opening 54 may be provided for maintenance or repair.

As shown in FIGS. 1 and 4, the sidewall portion 28 has a parabolic surface of revolution (PSR) shape, particularly around the standing area 20 which extends outwardly from the standing area 20 to provide a larger space for a bather (not shown) greater than a footprint provided by the standing area 20.

Figure 8:
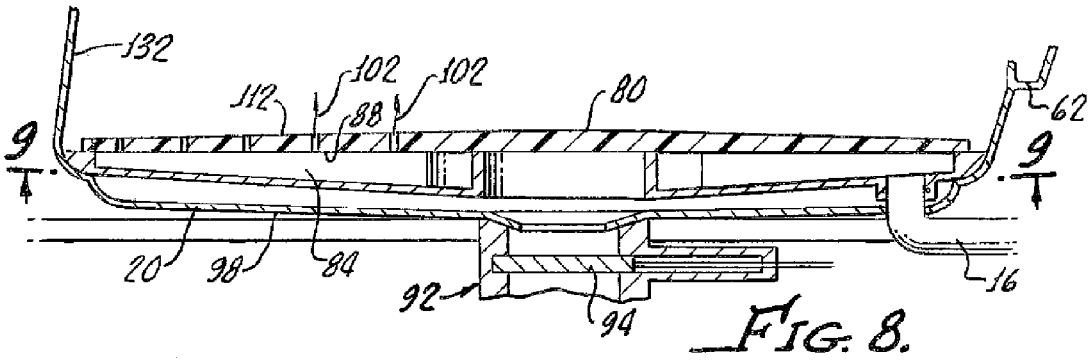
FIG. 8 is a cross sectional view of the standing area and grate shown in FIG. 4.

As best shown in FIGS. 4 and 8, the sidewall portion 28 includes a track 62 for supporting a pocket door 66, adjacent the sidewall portion 28, for enclosing the access opening 32 as also shown in FIG. 3.

The use of a pocket door 66 enables a wider access opening 32 to be utilized than would otherwise be possible with a hinged door, not shown.

A door rail 70 fixed to the pocket door 66 in any conventional manner facilitates opening and closing of the door 66. In addition, the door rail 70 provides a structural bridge across the access opening 32 when closed.

Figure 7:
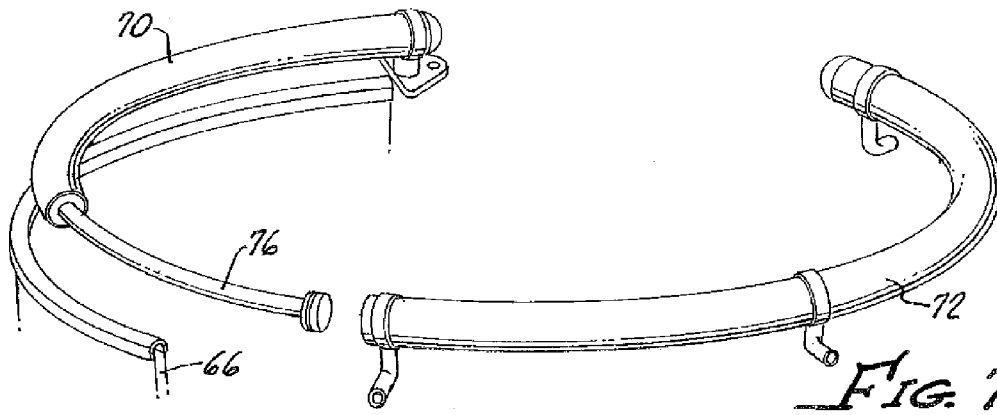
FIG. 7 is a perspective exploded view of a shell handrail and door handrail along with a piston disposed within the shell handrail for hydraulic operation of the door.

The door 66 may be manually open and closed by the rail 70; however, preferably a shell hand rail 72 is disposed in a conventional manner proximate the shell top 36 which includes a piston 76 disposed therein, see FIG. 7, with the piston being connected to the door hand rail 70 for hydraulically opening and closing the door. Hydraulic movement of the piston in the shell hand rail 72 is done in a conventional manner and specific hydraulic connections are not described herein for the sake of clarity.

With reference to FIGS. 4, 8-9, there is shown a grate 80 removably covering the standing area 20 for providing a level standing area. The grate 80 enables water passage thereto and includes a plurality of support ribs 84, 86 disposed on an underside 88 of the grate 80.

A conventional drain 92 with a drain valve 94, operable in any conventional manner, is disposed at a bottom 98 of the shell 14 and best seen in FIG. 8.

Hydraulics, including water filling and draining of the enclosure 10, may be done in any conventional manner and not described herein for the sake of clarity.

To provide bubbling in the water (not shown) within the shell 14, as illustrated by air flow arrows 102 in FIG. 8, some of the support ribs 84 as illustrated in FIG. 9 are hollow or include parallel walls 106, 108 which communicate with holes 112 in the grate (see FIG. 8) and an air supply 116 for causing bubbling in a water filled shell 14. The air pump and communicating ducts not being shown inasmuch as they are in conventional in nature.

Figure 11:
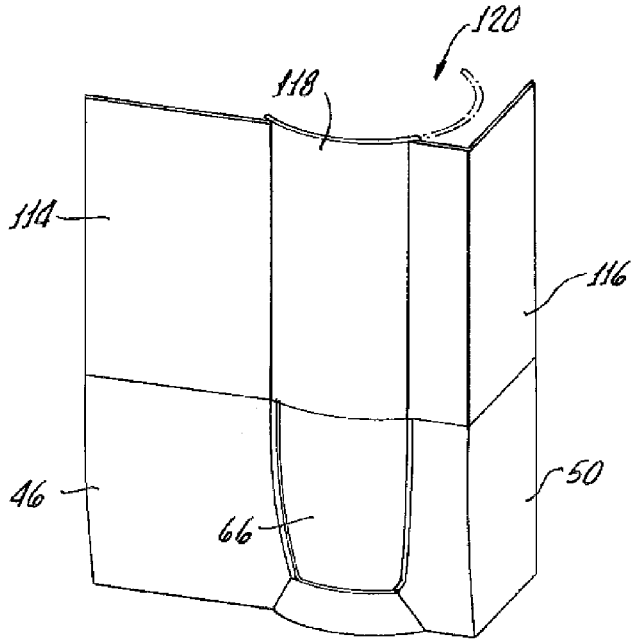
FIG. 11 illustrates the enclosure shown in FIGS. 2 and 3 along with a top front panel, top side panels, and a top door panel attachable respectively to the front panel, side panels, and door for providing a showering area for a bather.

Referring to FIG. 11, a top front panel 114, top side panel 116, and top door panel 118 may be provided and conventionally attached respectively to the front panel 46, pocket door 66, and side panel 50 in order to provide a showering area for standing bather, not shown. The top door panel 118 may optionally not be attached to the door 66 for movement therewith but be independently slideable into the top front panel 114.

Figure 10:
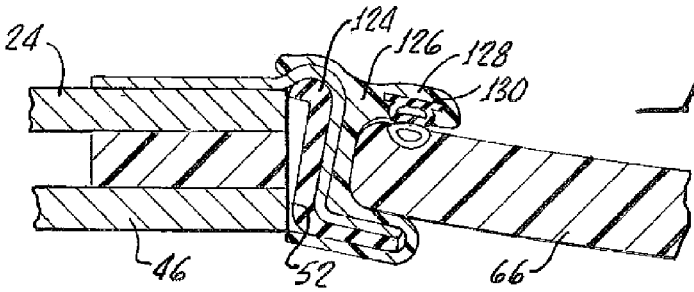
FIG. 10 is a cross sectional view taken along the line 10-10 of FIG. 3 illustrating a seal between the door and the side panel provided by inflatable gaskets.

With reference to FIG. 10, engagement between the pocket door 66 and front panel 46 is shown in cross section illustrating engagement fittings 124, 126, 128 along with an inflatable gasket 130 for sealing the door 66 in the access opening 32, the inflatable gasket 130 being conventional in manufacture and operation.

The gasket 130 is preferably hydraulic and also provides for locking of the door 66 in the access opening 32. When filled with water, the gasket 130 is effectively solid and movement is prevented between the door 66 and fillings 124, 126, 128.

With specific reference to FIG. 4, the seating area 18 is elevated from the standing area 20 and is interconnected therewith by a seat wall 132 which is "undercut" in order to enable a seated bather (not shown) to have a heel position 136 directly below a seat edge 138 to facilitate standing of the bather from a seated position.

Figure 12:
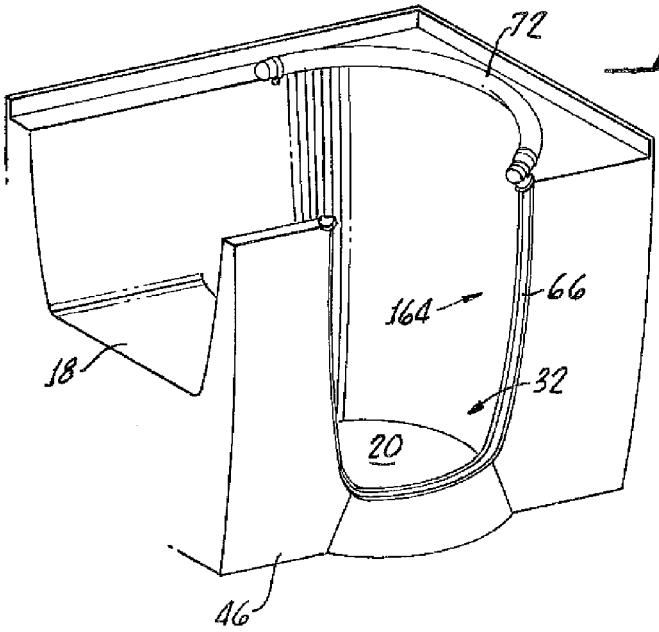
FIGS. 12-14 illustrate an alternative embodiment of the present invention showing an arcuate door sliding within a sidewall around a standing area.
Figure 13:
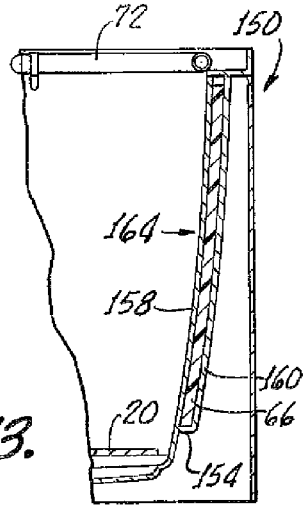
Figure 14:
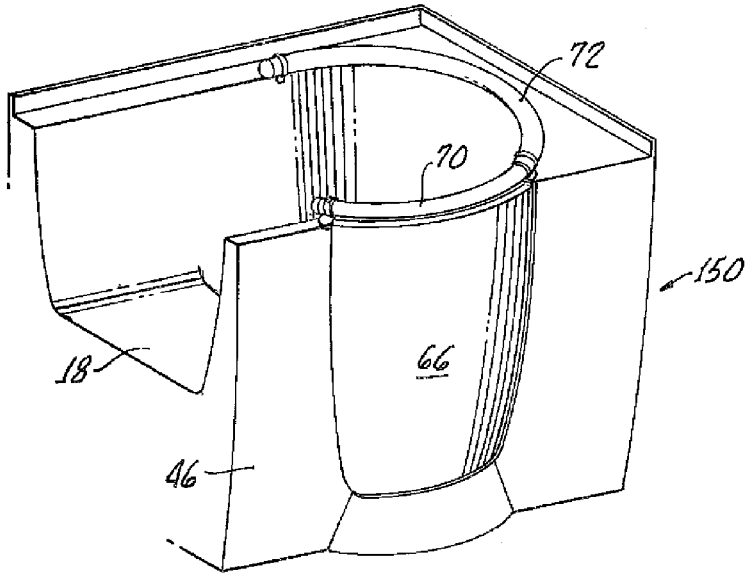

With reference to FIGS. 12-14, there is shown an alternative embodiment of the enclosure 150 in accordance with the present invention with identical or substantially similar components indicated by common character references as hereinbefore discussed in connection with the enclosure 10.

The enclosure 150 is substantially identical to the enclosure 10 except that the access door 66 is supported by a track 154 between an inside wall 158 and an outside wall 160 of a sidewall 164. Alternatively, the outside wall 160 may be eliminated with the door 66 being supported adjacent the wall 164 on an outside thereof by the track 154. Further features of the enclosure 150 are identical to the features of the enclosure 10 hereinabove described.

Although there has been hereinabove described a specific modular easy access bathing enclosure in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A modular easy access bathing enclosure comprising:

a frame;

a shell supportable by said frame along a shell top, said shell being formed with a standing area supportable by a floor and an adjacent contiguous seating area along with an arcuate sidewall including an access opening extending from the shell top to an opening bottom, said frame and shell being separable for enabling on-site assembly;

separate front and side panels removably attachable to said frame for enclosing said shell;

an arcuate sliding door for enclosing said access;

gaskets for sealing the door in said access opening;

a door handrail disposed proximate a door top for facilitating opening and closing of the door; and a shell handrail, disposed proximate a shell top, for receiving said door handrail, said door handrail being telescoped within said shell handrail.

2. The enclosure according to claim 1 further comprising a track, disposed adjacent the sidewall for supporting the door.

3. The enclosure according to claim 1 further comprising a track disposed within the sidewall for supporting the door.

4. The enclosure according to claim 1 wherein said shell including a seating area and a standing area with the sidewall being contiguous therewith and said access opening enclosure for the shell top to an opening bottom proximate the standing area.

5. The enclosure according to claim 1 wherein said gaskets are inflatable locking gaskets for securing the door in said access opening.

6. The enclosure according to claim 4 further comprising a frame for supporting the shell along with front and side panels for enclosing said frame, the front panel having a cutout for alignment with the shell access opening.

7. The enclosure according to claim 6 wherein said shell, the door, the frame and the front and side panels are fabricated for on-site assembly and passage through a doorway.

8. The enclosure according to claim 7 further comprising a drain, with a drain valve, disposed at a bottom of said shell.

9. The enclosure according to claim 1 further comprising a piston disposed within said shell handrail, said piston being connected to the door handrail for hydraulically opening and closing the door.

10. The enclosure according to claim 4 further comprising a top front panel, top side panels and a top door panel attachable respectively to the front panel, side panels, and door for providing a showering area for a bather.

11. The enclosure according to claim 8 wherein the standing area is generally circular and said drain is disposed proximate a center of the standing area.

12. The enclosure according to claim 11 further comprising a grate removably covering the standing area for providing a level standing area, the grate enabling water passage therethrough and includes a plurality of support ribs on an underside of the grate.

13. The enclosure according to claim 11 wherein a number of the support ribs are hollow and communicate with both holes in the grate and an air supply for causing bubbling in a water filled shell.

14. The enclosure according to claim 4 wherein the seating area is elevated from the standing area and interconnected by a generally vertical seat wall for facilitating standing of a user from a seated position.

15. A modular easy access bathing enclosure comprising:

a frame;

a shell having a seating area and a generally circular standing area supported by said frame along a shell top, said shell being formed with a standing area supportable by a floor and an adjacent contiguous seating area along with a contiguous sidewall, the sidewall having a parabolic surface of revolution (PSR) shape around the standing area and an access opening extending from the shell top to an opening bottom proximate the standing area, the PSR shape extending outwardly from the standing area, said frame and shell being separable for enabling on-site assembly;

separate front and side panels removably attachable to said frame for enclosing said shell;

a PSR shaped pocket door for enclosing said access opening and moveable into the sidewall surrounding the standing area;

inflatable gaskets for sealing the door in said access opening;

an arcuate handrail disposed proximate a door top for facilitating opening and closing of the door; and a arcuate shell handrail, disposed proximate the shell top, for receiving said door handrail, said door handrail being telescoped within said shell handrail.

16. The enclosure according to claim 15 further comprising a track, disposed within the sidewall around the standing area, for supporting the door.

17. The enclosure according to claim 15 further comprising a drain, with a drain valve, disposed at a bottom of said shell.

18. The enclosure according to claim 15 further comprising a frame for supporting the shell along with front and side panels for enclosing said frame, the front panel having a cutout for alignment with the shell access opening, the door extending outwardly from the front panel when sealed in said access opening.

19. The enclosure according to claim 18 wherein said shell, the door, the frame and the front and side panels are fabricated for on-site assembly and passage through a doorway.

20. The enclosure according to claim 15 further comprising an arcuate piston disposed within said arcuate shell handrail and connected to the door handrail for hydraulically opening and closing of the door.

21. The enclosure according to claim 15 further comprising a top front panel, top side panels and a top door panel attachable respectively to the front panel, side panels, and door for providing a showering area for a user.

22. The enclosure according to claim 17 wherein said drain is disposed proximate a center of the standing area.

23. The enclosure according to claim 22 further comprising a grate removably covering the standing area for providing a level standing area, the grate enables water passage therethrough and includes a plurality of support ribs on an underside of the grate.

24. The enclosure according to claim 23 wherein a number of the support ribs are hollow and communicate with both holes in the grate and an air supply for causing bubbling in a water filled shell.

25. The enclosure according to claim 15 wherein the seating area is elevated from the standing area and interconnected by a generally vertical seat wall for facilitating standing of a user from a seated position.

* * * * *